US006477822B1

(12) United States Patent
Spatafora et al.

(10) Patent No.: US 6,477,822 B1
(45) Date of Patent: Nov. 12, 2002

(54) METHOD AND DEVICE FOR CONTINUOUSLY WRAPPING PRODUCTS

(75) Inventors: Mario Spatafora; Antonio Gamberini, both of Bologna (IT)

(73) Assignee: Azionaria Costruzioni Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 09/543,890

(22) Filed: Apr. 6, 2000

(30) Foreign Application Priority Data

Apr. 8, 1999 (IT) ..... BO99A0160

(51) Int. Cl.[7] ..... B65B 49/00
(52) U.S. Cl. ..... 53/461; 53/234
(58) Field of Search ..... 53/466, 234, 253, 53/579, 461, 232, 228, 249–252, 225, 578

(56) References Cited

U.S. PATENT DOCUMENTS 3,810,314 A 5/1974 Anderson
6,141,944 A * 11/2000 Spatafora ..... 53/466

FOREIGN PATENT DOCUMENTS

EP 0 608 823 8/1994
EP 0 608 824 8/1994
EP 2 297 957 8/1996
EP 0 769 453 4/1997
EP 0 806 347 11/1997

* cited by examiner

*Primary Examiner*—John Paradiso
(74) *Attorney, Agent, or Firm*—The Law Offices of Timothy J. Klima

(57) ABSTRACT

The invention relates to a method and device for continuously wrapping products, according to which, during the continuous feed of the products and respective intermediate wrappers which have four flaps to be folded, projecting in such a way that they are offset from the lower surface of the product, along a path with an instantaneous tangent extending in a first direction which may vary from point to point on the path, two opposite flaps make contact with respective first and second folding tools, located on opposite sides of an intermediate folding portion of the path. During their movement along respective closed paths, the first and second folding tools are subject to a first movement in a second direction transversal to the first direction, a second movement in the first direction, and a third movement, consisting of an oscillation about a relative longitudinal axis, so that each folding tool pursues and folds each flap, whilst remaining parallel with the instantaneous tangent and, therefore, with the surface of each product.

17 Claims, 8 Drawing Sheets

F7
F8
PL2
P
D1
T

METHOD AND DEVICE FOR CONTINUOUSLY WRAPPING PRODUCTS

BACKGROUND OF THE INVENTION

The present invention relates to a method for continuously wrapping products.

The present invention is advantageously used in the wrapping of foodstuffs, such as chocolates and similar products, to which the following description refers, although without limiting the scope of application of the invention.

In wrapping machines, a succession of products is positioned at regular intervals and fed in an orderly manner along a given path to a pick up station, where the products are gripped by transfer means and fed firstly to a feed station, in which a sheet of wrapping material is associated with each product and, gradually, through a succession of folding stations, designed to form a closed wrapper around each product to be wrapped.

The products are normally fed to the pick up station by an infeed conveyor, whilst the transfer means are normally a rotary conveyor equipped with a plurality of peripheral pick up grippers, which move towards the conveyor in order to pick up the products in succession and transfer them to a first wrapping drum.

The first wrapping drum rotates about a respective axis of rotation and has a plurality of peripheral pick up units, designed to pick up the products and feed them through the feed station and along a folding station in which each sheet is partially wrapped around the relative product to form a wrapper which is substantially folded in a U-shape.

The sets consisting of the products and the relative sheets are then transferred, at a transfer station, to a second wrapping drum, which rotates about a respective axis of rotation parallel with the axis of rotation of the first drum. The second wrapping drum, in turn, has a plurality of peripheral pick up units, each consisting of a pair of jaws set opposite one another, projecting radially away from the drum and arranged symmetrically relative to an axis which is substantially radial relative to the drum. Said jaws are designed to follow a substantially circular path about the axis of rotation of the second drum, in order to feed the sets consisting of the products and sheets through the succession of folding stations.

The folding operations to which each sheet folded into a U-shape must be subjected in order to obtain a closed wrapper encompassing the product envisage a first operation in which each of the two sides of the sheet projecting beyond the corresponding side of the product are folded, thus further folding of the sheet of wrapping material, which assumes the form of a box-shaped, substantially parallelepiped intermediate wrapper inside whose top portion, facing the second drum, the product is housed, whilst the opposite part, the bottom, is open and consists of four side flaps. The side flaps project away from the drum and away from an end surface of the product. Pairs of the side flaps are substantially opposite to and parallel with one another and parallel with the axis of symmetry of the pick up jaws and, specifically, two of the side flaps are parallel with the plane in which the second drum lies and with the circular path.

The subsequent folding operations to which each intermediate wrapper must be subjected in order to obtain a closed wrapper envisage firstly the folding, in succession, of the two opposite flaps which are parallel with the plane in which the second drum lies, so as to define two substantially rectangular wings, in direct contact with the bottom of the product and partially overlapping. The other two flaps assume a substantially triangular or trapezoidal configuration and define a pair of second wings substantially perpendicular to the bottom of the product, which are then folded one on top of the other to completely close the wrapper.

The flaps parallel with the plane in which the second drum lies are normally folded by a pair of folders set opposite one another and having a straight, cyclical alternating motion in a direction substantially perpendicular to the plane in which the second drum lies and the substantially circular path along which the pick up jaws move. The movement of the folders is, therefore, substantially perpendicular to the flaps of the wrapper and the relative folding stage occurs when the product—sheet of wrapping material sets are stopped at the folders.

This folding method has the disadvantage caused by the fact that, in order to increase the speed of production, it has become essential to reduce the time for which the product—sheet of wrapping material sets stop, thus increasing the speed of movement of the folders during their forward and return strokes. This may cause tears in the wrapping materials which form the wrapper, especially those which are not particularly strong, due to the high-level impacts with which the folders make contact with the flaps to be folded. The wrapper may also be moved from its correct position around the product, resulting in a large number of rejects.

The same problem arises in the case of tubular wrappers, wrapped around a product and closed at the sides, in which each of the two ends of the wrapper projecting beyond the ends of the product is folded to define only two side wings, parallel with the plane in which the drum lies.

The aim of the present invention is to provide a method for continuously wrapping products which allows the flaps of a partial wrapper to be folded in such a way that the product—sheet of wrapping material sets do not need to stop and the folding stage is effected gradually, without excessive impacts, and without the disadvantages mentioned above relative to the prior art.

SUMMARY OF THE INVENTION

Accordingly, the present invention provides a method for continuously wrapping products, comprising stages for the continuous feed along a given path, an instantaneous tangent of which extends in a first direction which may vary from point to point on the path, of a succession of products to be wrapped, together with respective sheets of wrapping material, at least partially folded around the respective products to define an intermediate wrapper with at least one flap substantially parallel with the plane in which said path lies and projecting in such a way that it is offset from a surface of the product; folding of the flap by at least one folding tool which extends along a respective axis and cooperates with the first flap during the continuous feed of the intermediate wrapper and relative product along an intermediate folding portion of the path. The folding tool moves in a continuous, cyclical fashion along a closed path and moves with a law of motion which derives from the combination of at least two distinct movements, one of which is a movement in a second direction parallel with its own longitudinal axis and transversal to the plane in which the flap lies. The other movement is in the first direction of the path, following the continuous feed of the intermediate wrapper and relative product along the intermediate folding portion, and allowing the flap to be brought into contact with the surface of the product.

The present invention also relates to a device for continuously wrapping products, comprising, along a portion of a wrapping machine equipped with a frame and a wall, a wrapping device having means for feeding, in a continuous fashion and along a given path, an instantaneous tangent of which extends in a first direction which may vary from point to point on the path, a succession of products to be wrapped, together with respective sheets of wrapping material which are at least partially folded around the products to define an intermediate wrapper with at least one flap substantially parallel with the plane in which the path lies and projecting in such a way that it is offset from a surface of the product; a folding device, designed to fold the flap and comprising at least one folding tool which extends along a respective axis and cooperates with the flap during continuous feed of the intermediate wrapper and relative product along an intermediate folding portion of the path. Said folding tool moves in a continuous, cyclical fashion along a closed path and moves with a law of motion which derives from the combination of at least two distinct movements. One is a movement in a second direction parallel with its own longitudinal axis and transversal to the plane in which the flap lies. The other movement is in the first direction of the path, following the continuous feed of the intermediate wrapper and relative product along the intermediate folding portion, and allowing the flap to be brought into contact with the surface of the product.

BRIEF DESCRIPTION OF THE DRAWINGS

The invention will now be described with reference to the accompanying drawings, which illustrate an embodiment of the invention, without limiting the scope of its application, and in which:

FIGS. 5*a* to 14*a* are schematic side views, seen from X in FIG. 2, of the path followed by the detail of the folding device illustrated in FIGS. 5 to 14 during the succession of operating stages.

DESCRIPTION OF THE PREFERRED EMBODIMENTS

Figures 1, 1A, 1B, 1C, 1D:
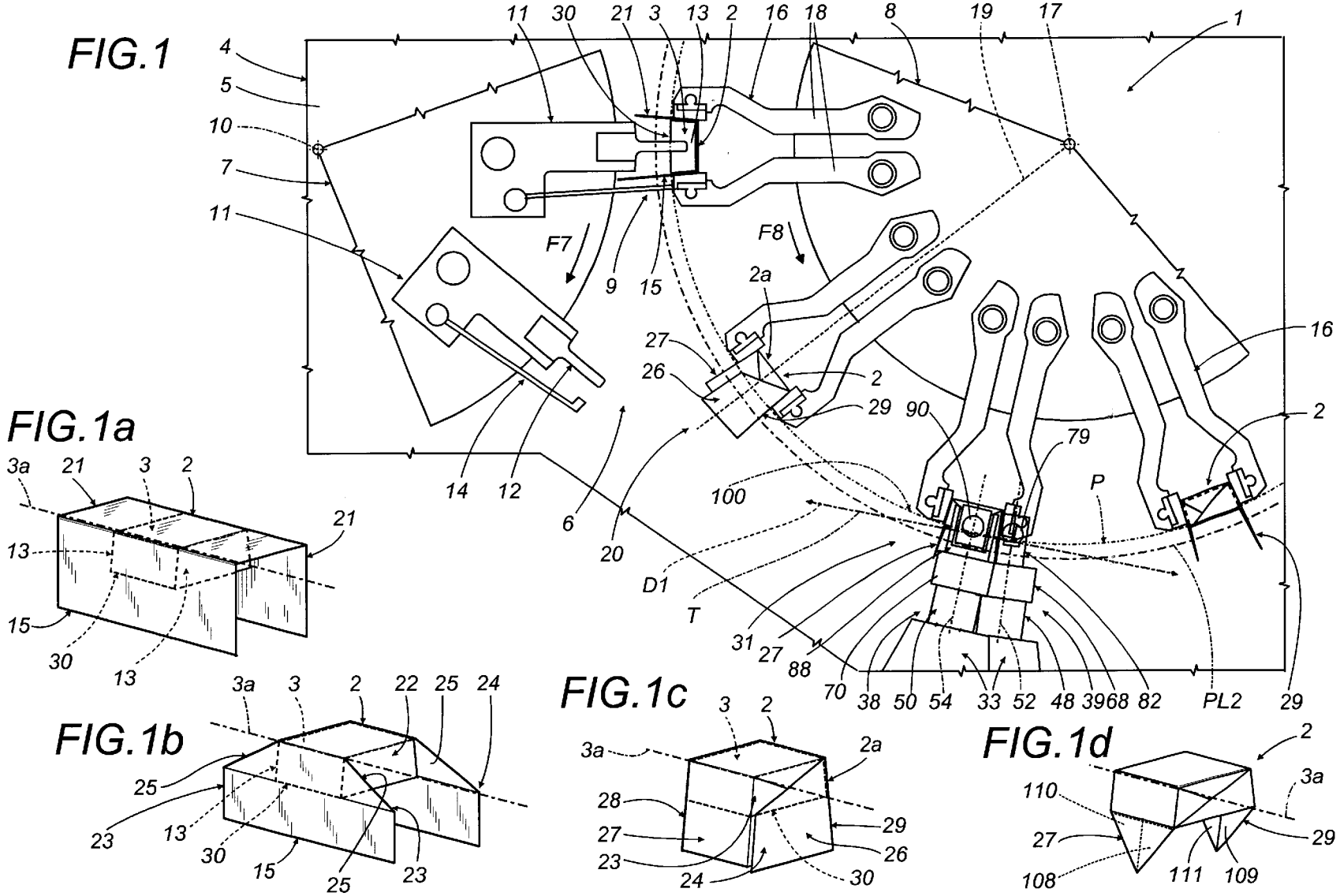
FIG. 1 is a schematic side view, with some parts cut away to better illustrate others, of a portion of a wrapping machine equipped with a folding device which uses the method according to the present invention for folding the respective flaps of a product wrapper.
FIGS. 1*a* to 1*d* are perspective views of a succession of stages for folding a wrapper around the relative product.

With reference to FIG. 1, the numeral 1 indicates, as a whole, a portion of a wrapping machine designed to apply wrappers 2 around products which, in the case in question, are chocolates 3 which substantially have the shape of a parallelepiped.

The portion 1 of the wrapping machine has a frame 4 with a vertical front wall 5, and comprises a wrapping device 6, which comprises a first wrapping drum 7 and a second wrapping drum 8 of the known type and tangential to one another at a transfer station 9. The first and second wrapping drums 7, 8 are only partially illustrated and are of the type described in the applications for European patents No. 608,823 and No. 608,824, which should be consulted for a more complete description of their structure and operation. The drum 7 is supported by the wall 5 in such a way that it rotates about an axis 10 which is horizontal and perpendicular to the wall 5, at a substantially cons-ant speed and in a clockwise direction according to the arrow F7 in FIG. 1. The drum 7 comprises a plurality of peripheral, radial gripper pick up units 11, each comprising two jaws 12 (only one of which is visible), mobile towards one another in a direction substantially perpendicular to the wall 5 to cooperate with the opposite longitudinal ends 13 of a chocolate 3 positioned with its longitudinal axis 3*a* (FIG. 1*a*) perpendicular to the wall 5, and another jaw 14 for gripping a sheet 15 of wrapping material fed from a feed device of the known type, not illustrated.

Each unit 11 is designed to bring together, in the known way, each chocolate 3 and a relative sheet 15 of wrapping material, and to fold the sheet 15 into an L-shape, then, as is more specifically illustrated in FIG. 1*a*, into a U-shape around the relative chocolate 3 while transferring the chocolate 3 from the unit 11 to a corresponding peripheral gripper pick up unit 16 on the second drum 8 at the station 9.

The drum 8 is supported by the wall 5 in such a way that it rotates about a respective axis 17 which is horizontal and perpendicular to the wall 5 and parallel with the axis 10 of the drum 7, at a substantially constant speed and in a counterclockwise direction according to the arrow F8 in FIG. 1. The second drum also has a plurality of peripheral pick up units 16, each comprising a pair of opposite jaws 18 which project radially away from the drum 8 and are arranged symmetrically relative to an axis 19 which is substantially radial relative to the drum 8.

As shown in FIG. 1, the jaws 18 are designed to follow a substantially circular path P about the axis 17, in order to feed the sets consisting of the chocolates 3 and sheets 15 along the path P, an instantaneous tangent T of which extends in a first direction D1 which may vary from point to point on the path P, through a known folding station 20.

At the folding station 20, as illustrated more specifically in FIGS. 1*b* and 1*c*, each longitudinal end 21 of the sheet 15 folded in a U-shape which projects beyond the corresponding longitudinal end 13 of the relative chocolate 3 is folded in the known way to define a small, substantially rectangular wing 22, in direct contact with the longitudinal end 13 of the chocolate 3, and a large inner wing 23 and a large outer wing 24, both substantially trapezoidal in shape and respectively having side inner reinforcing wings 25, which are substantially triangular, connecting the trapezoidal wings 23 and 24 to the rectangular wings 22 (FIG. 1*b*).

As illustrated in FIGS. 1 and 1*c*, the two trapezoidal wings 23 and 24 are then folded towards the rectangular wing 22, with the trapezoidal wing 24 partially above the trapezoidal wing 23, thus further folding the sheet 15 of wrapping material, which assumes the shape of a box-shaped intermediate wrapper 2*a*, substantially a parallelepiped, whose top portion facing the second drum (FIG. 1) houses the chocolate 3, whilst the opposite part, the bottom, is open and consists of four side flaps 26, 27, 28 and 29.

The flaps 26, 27, 28 and 29 project in such a way that they are offset from the lower surface 30 of the chocolate 3 and, as illustrated in FIG. 1, face away from the drum 8 and are substantially opposite, parallel pairs, and substantially parallel with the axis 19 of symmetry of the pick up jaws 18. Two of the flaps, labeled 26 and 28, lie in two planes which are substantially parallel with the plane in which the second drum 8 lies and with the circular path P. In particular, as illustrated in FIGS. 1, 2, 3 and 4, as the jaws 18 move along the path P, the flaps 28 and 26 follow respective paths PL1 and PL2 on opposite sides of the path P and parallel with it.

As is schematically and partially shown in FIG. 1, when the jaws 18 have left the station 20, they are designed to continuously feed the sets consisting of chocolates 3 and sheets 15 of wrapping material partially folded around the respective chocolate 3 in the intermediate wrapper configuration 2*a*, along the path P and downstream of the station 20, through a subsequent folding station 31, where the portion 1 of the wrapping machine comprises a folding device 32 designed to fold the flaps 26 and 28 squarely towards one another and in contact with the lower surface 30 of the chocolate 3, to obtain a wrapper 2 shaped as illustrated in FIG. 1*d*.

As illustrated more in detail in FIGS. 2 and 4, the folding device 32 is supported by a frame 33 supported in such a way that it is offset by the framework 4 of the portion 1 of the wrapping machine through the wall 5, below the second drum 8 (FIG. 1), and comprises a first and a second folding head 34, 35, set opposite one another and on opposite sides of the path P, each having a respective first and second folding tool 36, 37.

Each folding head 34, 35 is connected to a respective first and second mechanism 38, 39, each receiving motion from a first and second drive shaft 40, 41 which extend perpendicular to the wall 5, are aligned in an irregular fashion and have axes 42, 43 which are parallel and offset from one another by a given distance "d".

The two shafts 40, 41 are made to rotate about the respective axes 42, 43, in the direction indicated by the arrow F4, by a main drive shaft 44 which rotates in the direction indicated by the arrow F3 and is connected to the first drive shaft 40 by a pair of gearwheels 45. The two shafts are connected to one another at their breakpoint by a joint 46 which allows motion to be transmitted from the first drive shaft 40 to the second drive shaft 41 at a synchronous speed.

The first and second mechanisms 38, 39 also respectively comprise a first and second driven shaft 47, 48, and a third and fourth driven shaft 49, 50, each with its axis 51, 52, 53 and 54 askew relative to the axes 42, 43. The shafts 47, 48 and 49, 50 are kinematically connected, in pairs, to the corresponding drive shafts 40, 41 by respective first, second, third and fourth helical gear pairs 55, 56, 57 and 58. Said helical gear pairs 55, 56, 57 and 58 allow the transfer of motion from the first and second drive shafts 40, 41 to the first and second driven shafts 47, 48, which rotate about the respective axes 51, 52 in the direction indicated by the arrow F5 (clockwise in FIG. 4), and, respectively, to the third and fourth driven shafts 49, 50, which rotate about respective axes 53, 54 in the direction indicated by the arrow F6 (counterclockwise in FIG. 4). More specifically, the first drive shaft 40 has a first and second helical drive gear 59, 60, each respectively engaging with a first and second helical driven gear 61, 62, each keyed to the relative first and second driven shaft 47, 48. Similarly, the second drive shaft 41 has a third and fourth helical drive gear 63, 64, each respectively engaging with a third and fourth helical driven gear 65, 66, each keyed to the relative third and fourth driven shaft 49, 50.

The first, second, third and fourth driven shafts 47, 48, 49 and 50 have, rigidly connected to the end facing the second drum 8, respective first, second, third and fourth transversal arms 67, 68, 69 and 70, whose respective longitudinal axes 71, 72, 73 and 74 are substantially perpendicular to the axes 51, 52, 53 and 54 of the driven shafts 47, 48, 49 and 50. The first and, respectively, second folding heads 34, 35 are connected to the free ends of the arms.

Figure 2:
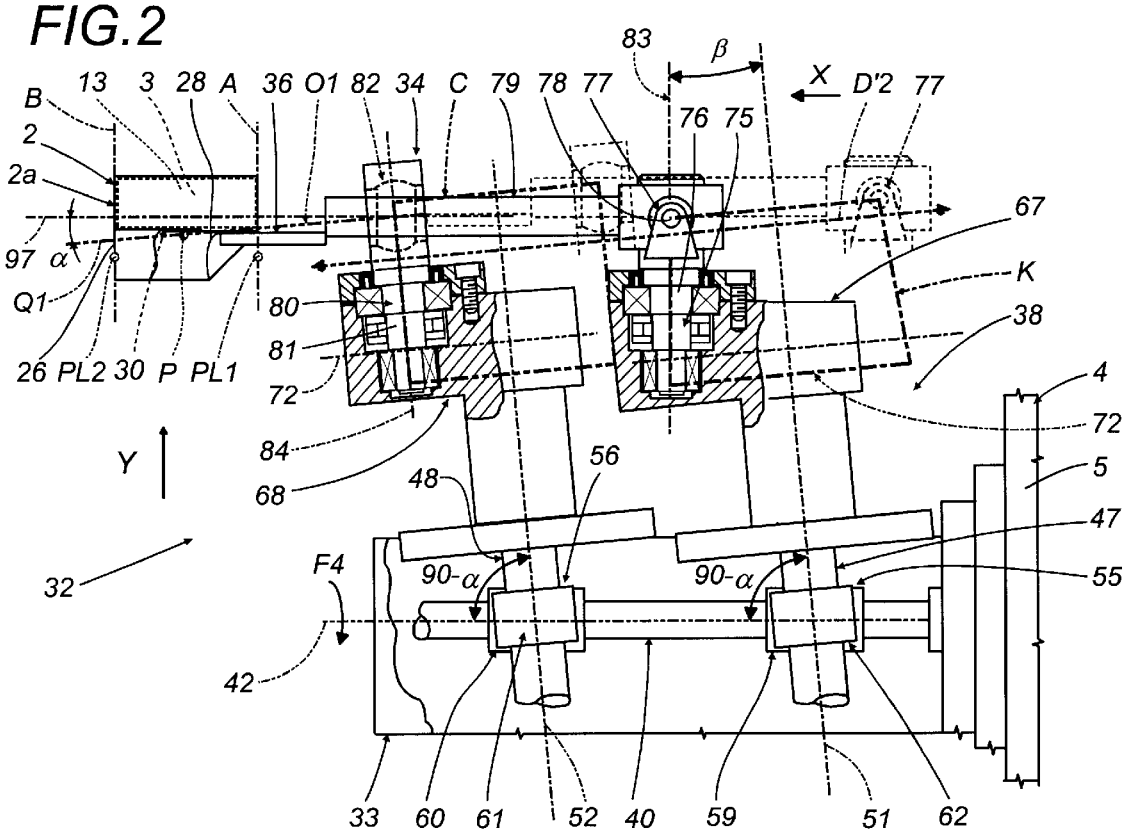
FIG. 2 is a schematic side view, with some parts cut away to better illustrate others, of part of the folding device.

In particular, in the case of the first mechanism 38, as illustrated in greater detail in FIG. 2, in which, for greater clarity, only part of the folding device 32 is shown, the other part being identical and symmetrical, the first folding head 34 is kinematically connected to the free end of the first arm 67 by a first turning pair 75 consisting of a first cylindrical guide pin 76 which has, at the end that extends outwards from the arm 67 towards the drum 8, a first fork 77 whose knuckle pin 78 passes through and supports one end of a first tubular rod 79.

At the free end of the second arm 68, the first head 34 is kinematically connected, by a second turning pair 80 consisting of a second cylindrical guide pin 81 which has, at the end that extends outwards from the arm 68 and towards the drum 8, a first ball joint 82 keyed directly to the first tubular rod 79, close to the other end of the latter facing the second folding head 35, the rod 79 having the first folding tool 36 at said other end.

Figure 4:
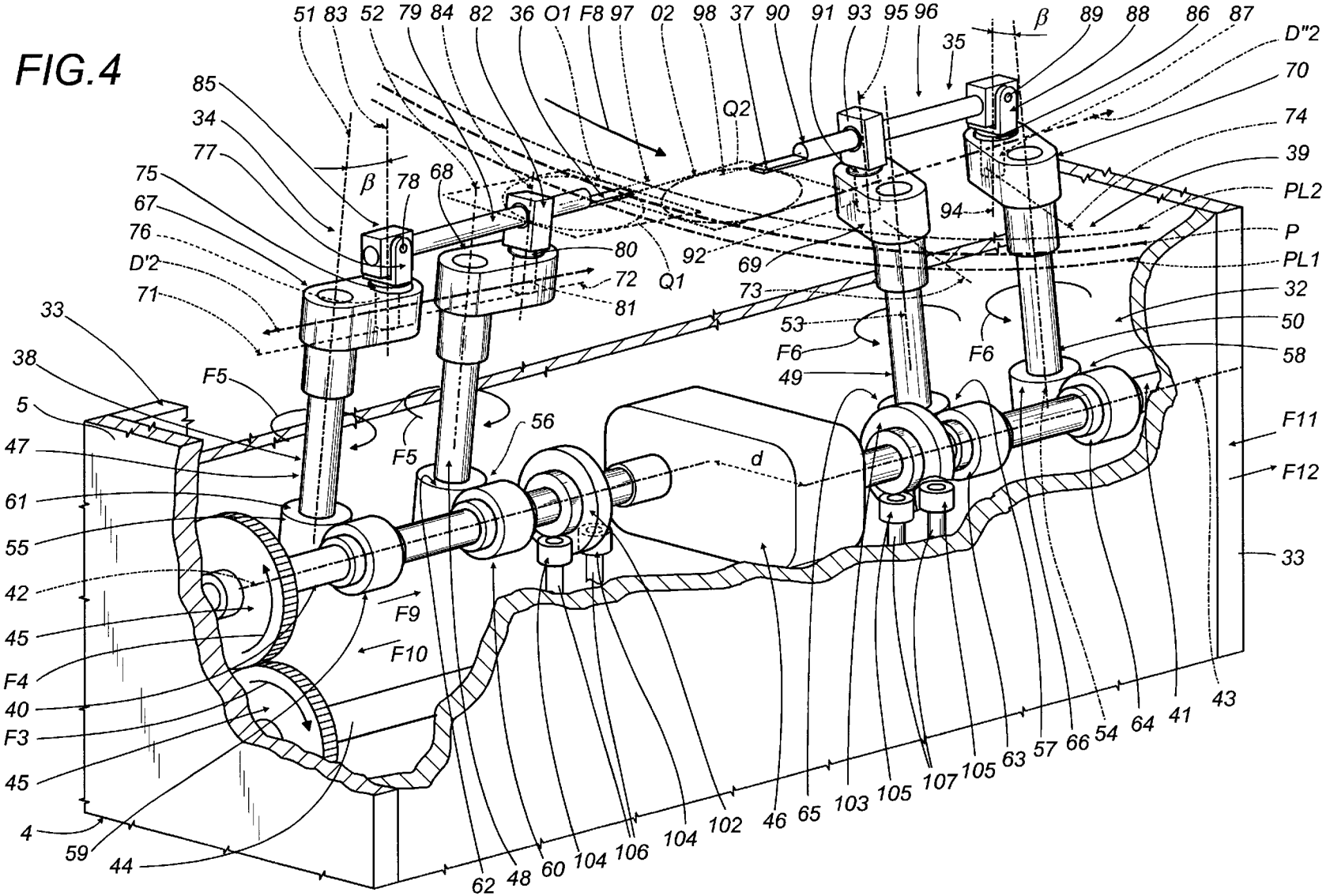
FIG. 4 is a schematic perspective view, with some parts cut away, of the device illustrated in FIG. 2.
Figure 6:
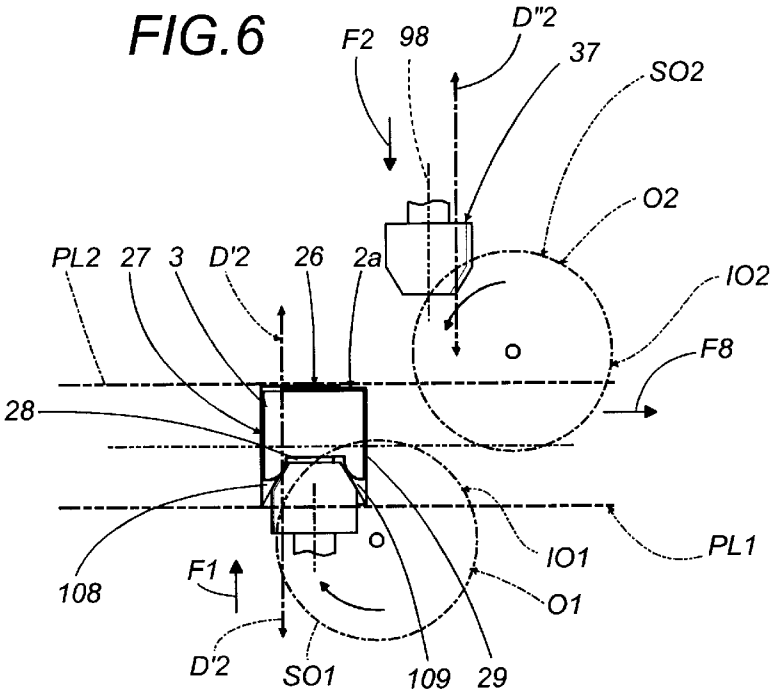
FIGS. 5 to 14 are schematic side views, seen from Y in FIG. 2, of a detail of the folding device in a succession of operating stages.
Figure 6A:
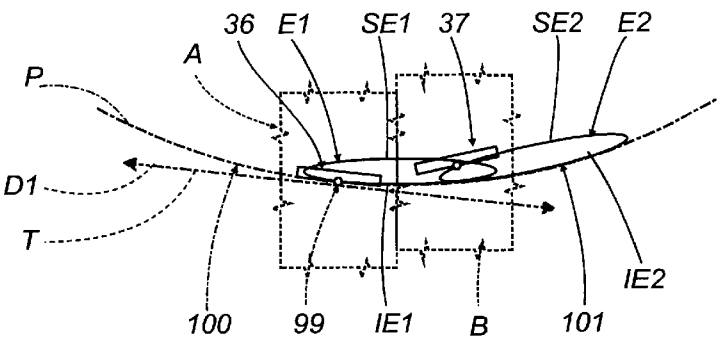

As illustrated in FIGS. 2 and 4, the axis 83 of the first pin 76 is inclined at a given angle "beta" relative to the axis 51 of the first driven shaft 47, whilst the axis 84 of the second pin 81 is parallel with the axis 52 of the second driven shaft 48.

With reference to the first mechanism 38, it should be noticed that the jointed system defined by the first and second arms 67, 68 and by the first rod 79 with the relative first and second turning pair 75, 80, constitutes a first four-bar linkage 85, its crankshafts consisting of the two arms 67 and 68 and the connecting rod consisting of the rod 79 in such a way that, following a rotation of the driven shafts 47 and 48 about the relative axes 51 and 52, the first rod 79 translates, without rotating about itself, keeping its longitudinal axis 97 parallel with the axis 42 of the first drive shaft 40.

Similarly, as regards the second mechanism 39, which is symmetrical with the first mechanism 38 about the vertical plane in which the path P lies, but offset by the distance "d" between the two axes 42, 43 respectively of the first and second drive shafts 40, 41, and as illustrated in FIG. 4, the second folding head 35 is kinematically connected to the free end of the fourth arm 70 by a fourth turning pair 86 consisting of a fourth cylindrical guide pin 87 which has, at its free end extending outwards from the arm 70 and towards the drum 8, a second fork 88 whose knuckle pin 89 passes through and supports one end of a second tubular rod 90.

At the free end of the third arm 69, the second head 35 is kinematically connected, by a third turning pair 91 consisting of a third cylindrical guide pin 92 which has, at the end that extends outwards from the arm 69 and towards the drum 8, a second ball joint 93 keyed directly to the second tubular rod 90, close to the other end of the latter facing the first folding head 34, the rod 90 having the second folding tool 37 at said other end.

As illustrated in FIG. 4, the axis 94 of the fourth pin 87 is inclined at a given angle "beta" relative to the axis 54 of the fourth driven shaft 50, whilst the axis 95 of the third pin 92 is parallel with the axis 53 of the third driven shaft 49.

Moreover, similarly to the first mechanism 38, with reference to the second mechanism 39, it should be noticed that the jointed system defined by the third and fourth arms 69, 70 and by the second rod 90 with the relative third and fourth turning pair 91, 86, constitutes a second four-bar linkage 96, its crankshafts consisting of the two arms 69 and 70 and the connecting rod consisting of the rod 90 in such a way that, following a rotation of the driven shafts 49 and 50 about the relative axes 53 and 54, the second rod 90 translates, without rotating about itself, keeping its longitudinal axis 97 parallel with the axis 43 of the second drive shaft 41.

In particular, as illustrated in FIGS. 2 and 4, the axes 51, 52 of the respective driven shafts 47, 48 are inclined at a given angle "90-alpha" relative to the axis 42 of the corresponding first drive shaft 40 and, similarly, in a mirroring effect relative to the plane in which the path P lies, the axes 53, 54 of the respective driven shafts 49, 50 are inclined by the same given angle "90-alpha" relative to the axis 43 of the corresponding second drive shaft 41.

As illustrated in FIGS. 2 and 4, and in FIGS. 5 to 14, each first and second folding tool 36, 37 moves cyclically and with continuous motion along a first and second closed path, respectively labeled 01 and 02. Each closed path, as illustrated in further detail in FIGS. 2 and 4, lies in a respective plane Q1 and Q2, each being inclined by an angle "alpha" relative to the longitudinal axes 97, 98 of the corresponding first and second rods 79, 90, complementing the angle "90-alpha" of inclination of the axes 51, 52, 53 and 54 of the driven shafts 47, 48, 49 and 50 relative to the axes 42, 43 of the corresponding drive shafts 40, 41.

As illustrated in FIG. 2 and FIGS. 5*a* to 14*a*, the projection of the path O1 along which the first tool 36 moves, in a plane A substantially coplanar with the plane in which the flap 28 lies, is a first elliptical path El along which the first tool 36 moves. More precisely, the ellipse E1 consists of two sections. One is a non-operating section, labeled SE1 and at the top in FIGS. 5*a* to 14*a*, corresponding to a non-operating portion SO1 of the path O1 which does not interfere with paths PL1 and P along which the flaps 28 and the sets of chocolates 3 and wrappers 2*a* are fed, the sets hereinafter also referred to as 3—2*a*. The other is an operating section, labeled IE1 and at the bottom in FIGS. 5*a* to 14*a*, corresponding with an operating portion IO1 of the path O1 which interferes with both path PL1 and path P, to make contact with and squarely fold the corresponding flap 28 so that the flap makes contact with the surface 30 of the respective chocolate 3.

The section IE1 of the ellipse E1 coincides with a first section 99 of an intermediate folding portion or arc 100 of the path P along which the first folding tool 36 operates, cooperating with the flap 28. Similarly, the projection of the path O2 along which the second tool 37 moves, in a plane B parallel with plane A (FIG. 2), and substantially coplanar with the plane in which the flap 26 lies, is a second elliptical path E2 along which the second tool 37 moves.

More precisely, the ellipse E2 consists of two sections. One is a non-operating section, labeled SE2 and at the top in FIGS. 5*a* to 14*a*, corresponding to a non-operating portion S02 of the path O2 which does not interfere with paths PL2 and P along which the flaps 26 and the sets of chocolates 3 and wrappers 2*a* are fed. The other is an operating section, labeled IE2 and at the bottom in FIGS. 5*a* to 14*a*, corresponding with an operating portion IO2 of the path O2 which interferes with both path PL2 and path P, to make contact with and squarely fold the corresponding flap 26 so that the flap makes contact with the surface 30 of the respective chocolate 3. The section IE2 of the ellipse E2 coincides with a second section 101, subsequent to the first section 99, of the intermediate folding portion 100 of the path P, along which the second folding tool 37 operates, cooperating with the respective flap 26.

As shown in FIGS. 3, 4 and 5 to 14, the width of the first and second folding tools 36, 37, measured parallel with the flaps 26 and 28, is approximately the same as the width of the flaps 26 and 28 and, consequently is approximately the same as the width of the lower surface 30 of a chocolate 3.

In this regard, for the sake of completeness and with the sole aim of facilitating the understanding of how the folding device 32, described in more detail later, below is a description of the positions assumed by a generic chocolate 3 and intermediate wrapper 2*a* set, at the folding station 31, as the set is fed along the path P with the lower surface 30 of the chocolate 3 angled at a tangent to the path P. A partial description of at least the operation of the first folding head 34 is also provided, bearing in mind that the second folding head 35 operates in a substantially identical way.

Figure 3:
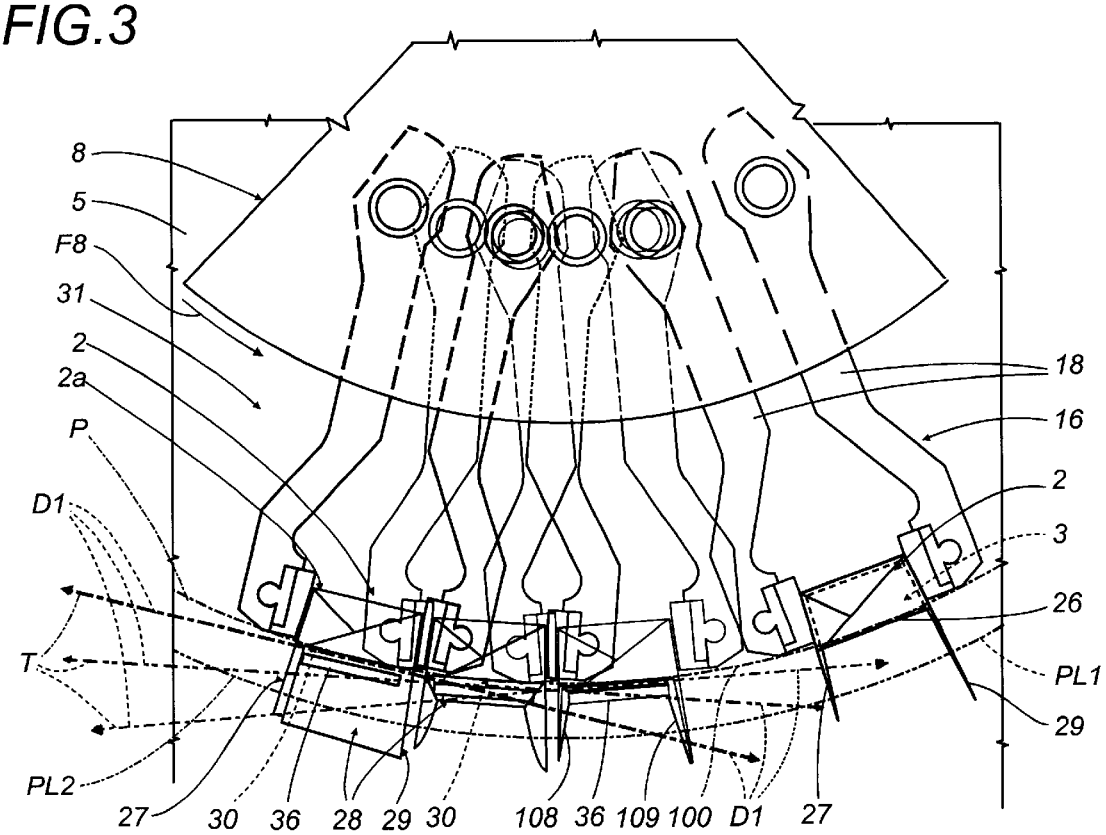
FIG. 3 is a scaled-up schematic side view, seen from X in FIG. 2 and with some parts cut away, of a detail from FIG. 1 relative to a peripheral pick up unit and the folding device in a succession of operating stages.

As illustrated in FIG. 1, and in particular in FIG. 3, at the folding station 31, the jaws 18 feed the sets consisting of the chocolates 3 and intermediate wrappers 2*a* along the intermediate folding portion or arc 100 of the path P.

Starting from a generic instantaneous position in which a generic set 3—2*a* is reached, for example, by the first folding tool 36 which begins the stage in which it folds the flap 28, the lower surface 30 of the chocolate 3 is tangential to a given point of the portion 100 of the path P and parallel with the instantaneous tangent T traced on the same given point of the portion 100 of the path P, the tangent T extending in a first direction D1.

As the set consisting of the chocolate 3 and the wrapper 2*a* is gradually fed along the portion 100 of the path P, the lower surface 30 of the chocolate 3 successively assumes infinite positions at tangents to the portion 100 of the path P. Amongst these infinite positions, the surface 30 assumes a position in which it is parallel with the horizontal plane and parallel with the instantaneous tangent T, parallel with the horizontal plane, traced at a point of the portion 100 of the path P which coincides with the instantaneous position occupied by the set 3—2*a*. Finally, the lower surface 30 of the chocolate 3 moves to a position in which the folding tool 36 has terminated its flap 26 folding stage and begins leaving the set 3—2*a*, at which point the surface 30 is at a tangent to another given point of the portion 100 of the path P and parallel with the instantaneous tangent T traced on the latter given point of the portion 100 of the path P. The tangent T extends in the first direction D1 which, varying from point to point on the path P, is inclined in a counterclockwise fashion relative to the horizontal plane.

As illustrated in FIGS. 2 and 4, following the rotation F5 of the first and second driven shafts 47, 48, the first four-bar linkage 85 translates the first rod 79 and causes the first folding tool 36 to follow the first closed path O1. During translation of the rod 79, the axis 84 of the second pin 81, which is parallel with the axis 52 of the second driven shaft, describes a cylinder, labeled C in FIG. 2, its axis 84 being a generatrix, whilst the axis 83 of the first pin 76, inclined at an angle "beta" to the axis 51 of the first driven shaft 47, describes a truncated cone, labeled K in FIG. 2, its axis 83 being a generatrix.

From the above description it may be deduced that during the movement of the first four-bar linkage 85, the fork 77 causes the first rod 79 to cyclically complete a clockwise and counterclockwise oscillation about its longitudinal axis 97, in such a way that, with reference to FIG. 3, the first folding tool 36, during its forward movement along the portion IO1 of the closed path O1, is always substantially parallel with the lower surface 30 of the chocolate 3 and, therefore, is also parallel with the instantaneous tangent T, in all of the positions assumed by the lower surface 30 of the chocolate 3 during its tangential forward movement along the folding portion 100 of the path P.

Similarly, as illustrated in FIG. 4, following the rotation F6 of the third and fourth driven shafts 49, 50, the second four-bar linkage 96 translates the second rod 90 and causes the second folding tool 37 to follow the second closed path O2. During translation of the rod 90, the axis 95 of the third pin 92, which is parallel with the axis 53 of the third driven shaft 49, describes a cylinder, not illustrated but identical to the cylinder labeled C in FIG. 2, its axis 95 being a generatrix, whilst the axis 94 of the fourth pin 87, inclined at an angle "beta" to the axis 54 of the fourth driven shaft 50, describes a truncated cone, not illustrated but identical to the truncated cone labeled K in FIG. 2, its axis 94 being a generatrix.

From the above description it may be deduced that during the movement of the second four-bar linkage 96, the fork 88 causes the second rod 90 to cyclically complete a clockwise and counterclockwise oscillation about its longitudinal axis 98, in such a way that the second folding tool 37, during its forward movement along the portion IO2 of the closed path O2, is always substantially parallel with the lower surface 30 of the chocolate 3 and, therefore, is also parallel with the instantaneous tangent T, in all of the positions assumed by the lower surface 30 of the chocolate 3 during its tangential forward movement along the folding portion 100 of the path P According to the above description and the illustrations in FIGS. 2 and 4, FIGS. 5 to 14 and FIGS. 5*a* to 14*a*, the first and second elliptical paths E1, E2 are followed by the respective first and second folding tools 36, 37, during their relative rotation along the first and second closed paths O1 and O2, with a law of motion which derives from the combination of three distinct movements. The first is a forward and return movement in the directions of the arrows F1 and, respectively F1', and F2 and, respectively F2', of each of the first and second tools 36, 37 in respective second directions D'2 and D"2, each transversal to the planes A and B in which the flaps 28 and 26 of the intermediate wrapper 2*a* lie, and parallel with the planes Q1 and Q2 in which the first and second closed paths O1, O2 lie.

The second movement is effected by each of the first and second tools 36, 37 in the first direction D1, in which the instantaneous tangent T extends, traced on the intermediate folding portion 100 of the path P along which the sets 3—2*a* are fed. As indicated above, the direction D1 gradually changes its angle of inclination from point to point on the intermediate portion 100 of the path P during the tangential forward movement of each set 3—2*a* in the direction indicated by the arrow F8. Said angle of inclination is always in the direction indicated by the arrow F8, so that the tangent T is always parallel with the lower surface 30 of the generic chocolate 3 during the stages in which the flaps 28, 26 of the intermediate wrapper 2*a* are folded by the respective first and second folding tools 36, 37. The timing of these two movements, performed by the first and second folding tools 36, 37, is controlled so that each tool 36, 37 follows the relative first and second elliptical path E1, E2 in such a way that it is synchronized with the other tool and with each relative peripheral pick up unit 16.

The third movement is an oscillation by the first and second tools 36, 37 about the axes 97, 98 of the respective first and second tubular rods 79, 90. This movement is designed to keep the first and second tools 36, 37 parallel with the lower surface 30 of the chocolate 3 as it is fed along substantially all of the relative first and second sections 99, 101 of the intermediate folding portion 100 of the path P.

As illustrated in FIG. 4, the first and second drive shafts 40, 41 are respectively keyed to a first and second cam 102, 103, which cooperate with the respective first and second pairs of idle gears 104, 105 supported by respective shafts 106, 107 fixed to the frame 33. The profiles of the first and second cams 102, 103 are shaped in such a way that, during the rotation of the respective first and second drive shafts 40, 41, and for each complete movement of the first and second folding tools 36, 37 along the respective first and second closed paths O1, O2, the cam profile cyclically imparts to the respective first and second drive shafts 40, 41 an alternating motion, along the axes 42 and 43, towards and away from the joint 46.

In particular, as is also illustrated in FIGS. 5 to 14, taking the first mechanism 38 as a reference and assuming the condition in which the first folding tool 36 translates along the first closed path O1 at a given speed such that, while it follows the operating portion IO1 of the closed path O1, its speed calculated in the first direction D1, which is the direction in which the sets 3—2*a* are fed along the path P, is always much greater than the speed of said set 3—2*a*, the cam 102 profile is shaped so that it is synchronized with the forward movement of the first tool 36 along the first closed path O1, and so as to impart to the first drive shaft 40 a first given axial movement towards the joint 46, in the direction and orientation indicated by the arrow F9, and a second axial movement, opposite to the first, away from the joint 46 and in the direction and orientation indicated by the arrow F10.

The first movement of the drive shaft 40, in the direction indicated by the arrow F9, is accelerated from the moment in which the tool 36 makes contact with the respective flap 28 to be folded (FIG. 5) and for the time during which it follows the operating portion IO1 to the point of maximum penetration in the wrapper 2*a* (FIG. 8), after which the movement in the direction indicated by the arrow F9 decelerates until the moment in which the tool 36 moves away from the set 3—2*a* (FIG. 11) having folded the flap 28 square against the surface 30 of the chocolate 3 and followed the entire portion IO1 of the closed path O1.

Following the first axial movement F9 of the first drive shaft 40, the first and second drive gears 59, 60 perform the same movement, which is first accelerated, then decelerated, in the direction and orientation indicated by the arrow F9, which is opposite to the direction and orientation F5 of the peripheral speed of each driven gear 61, 62 considered at their point of contact with the respective drive gears 59, 60. Thus, there is, firstly, a gradual and increasingly notable reduction in the speed of rotation of the driven gears 61, 62, followed by a gradual and increasingly notable increase in the speed of rotation of the driven gears 61, 62.

Figure 8:
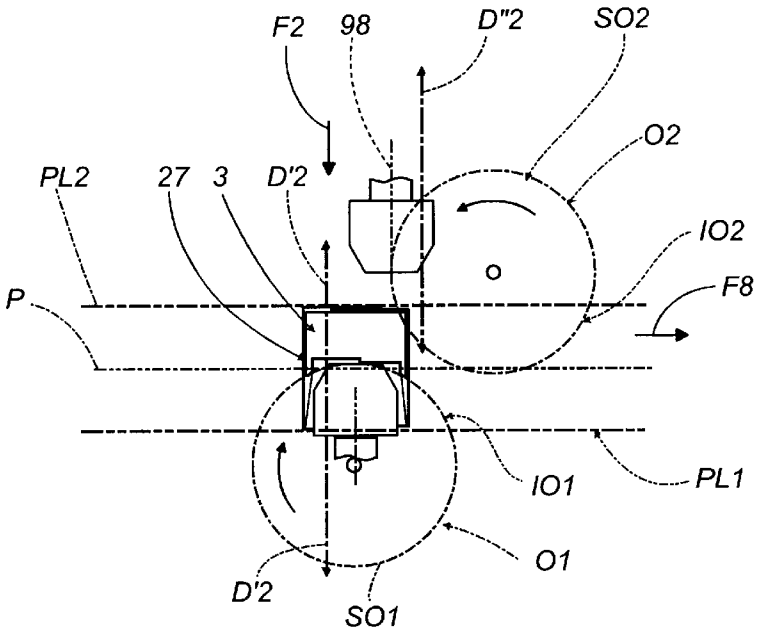
Figure 8A:
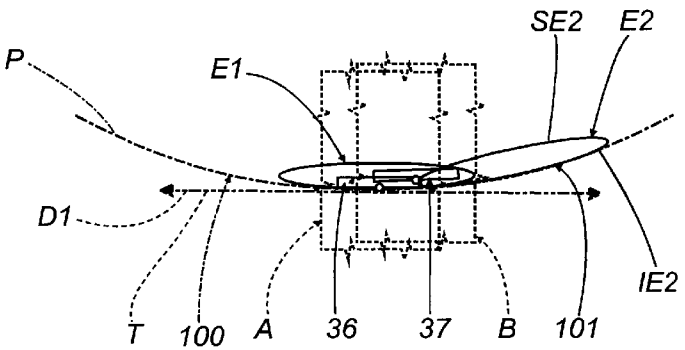
Figure 7:
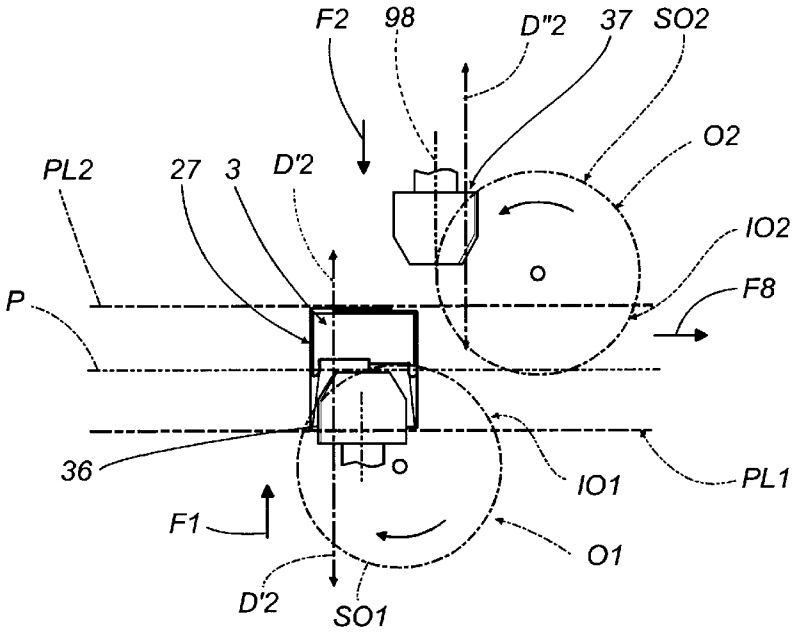
Figure 7A:
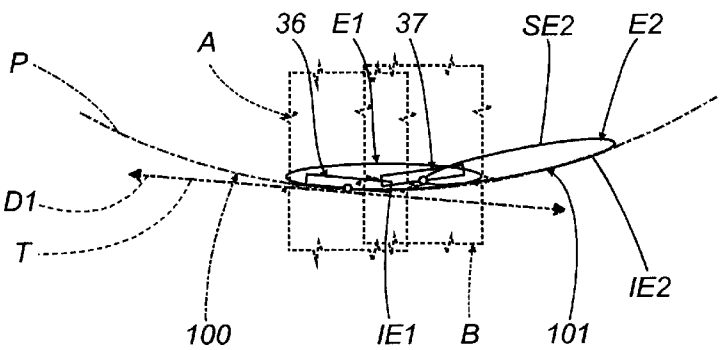
Figure 10:
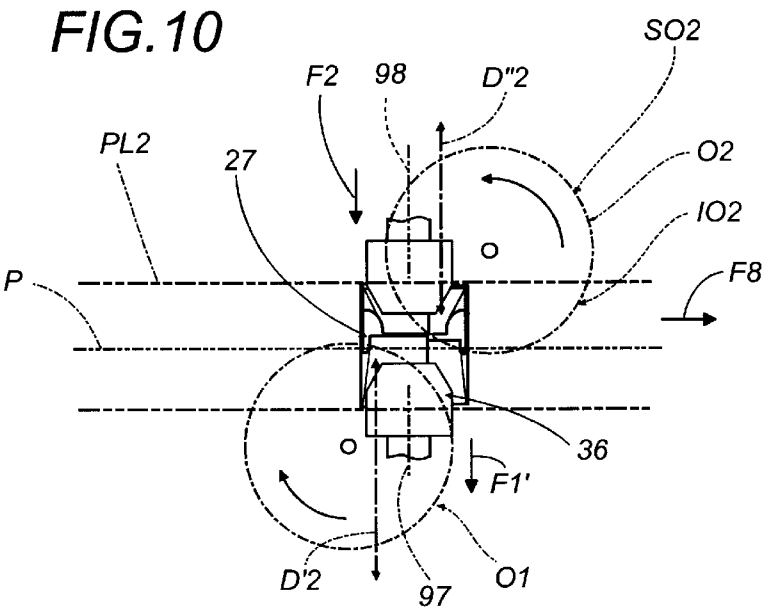
Figure 10A:
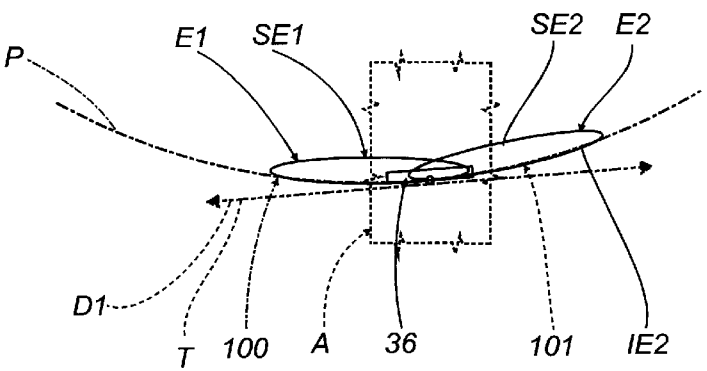

A gradual and increasingly notable reduction in the speed of rotation of the first and second driven gears 61, 62 corresponds with a gradual reduction in the speed of rotation of the respective first and second driven shafts 47, 48, which also corresponds with a gradual and increasingly notable reduction in the speed of the tool 36, starting from the moment in which the tool 36 makes contact with the flap 28 to be folded (FIG. 5) and for the time during which it follows the operating portion IO1 to the point of maximum penetration in the wrapper 2*a* (FIG. 8).

Figure 11:
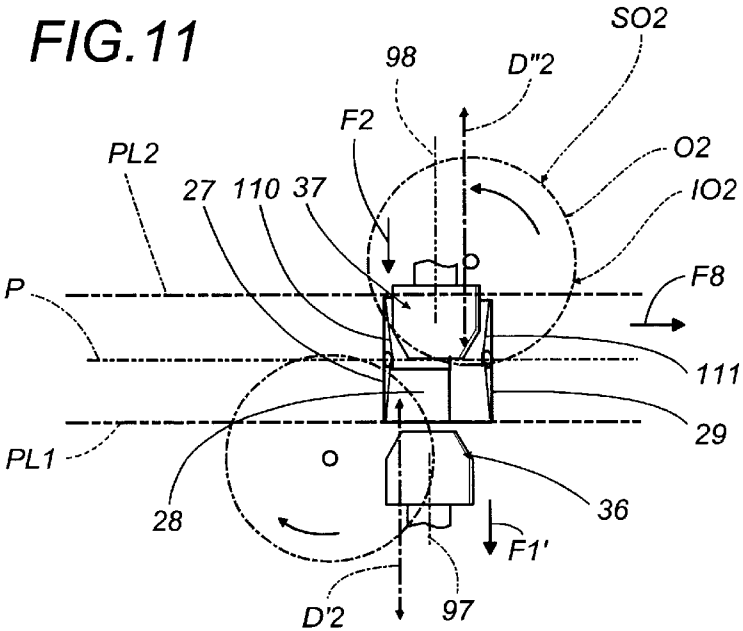
Figure 11A:
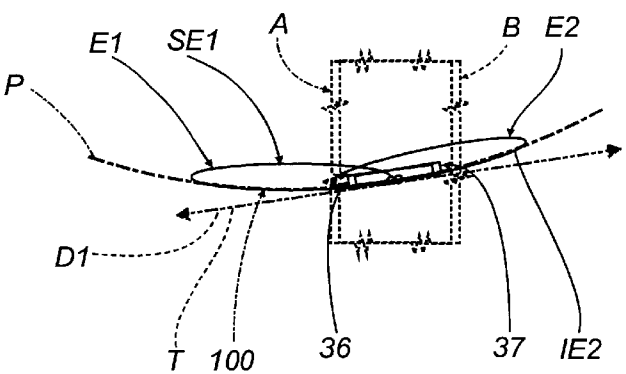
Figure 14:
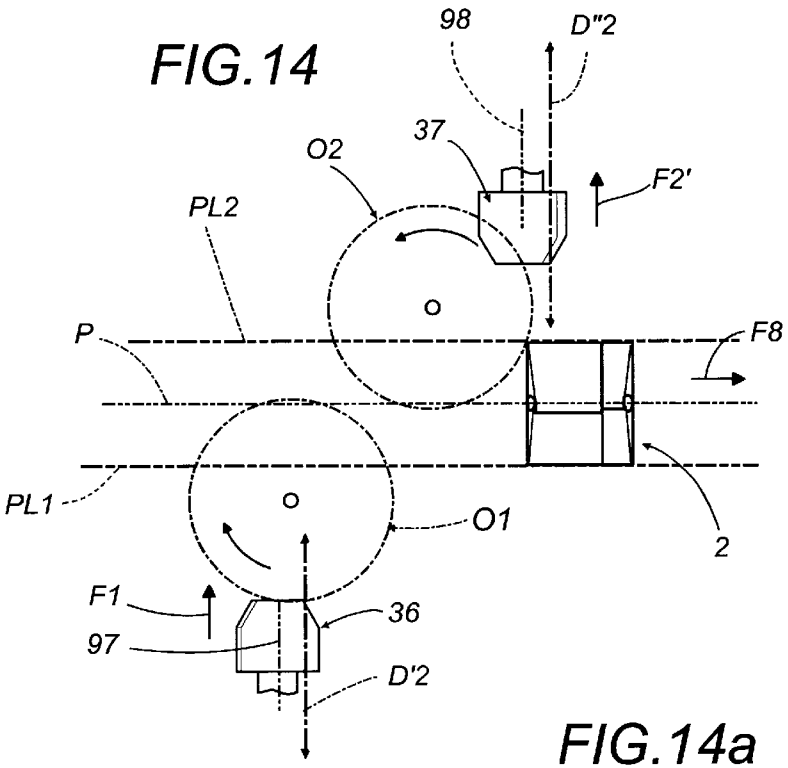
Figure 14A:
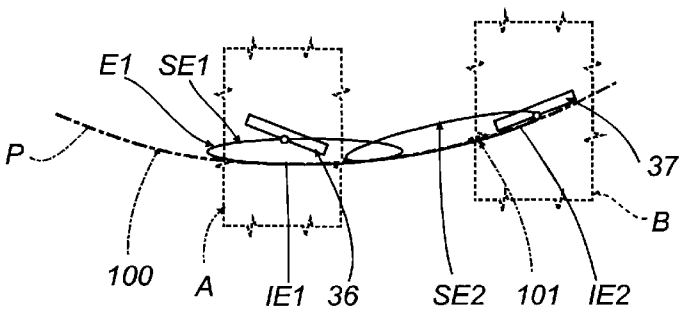
Figure 13:
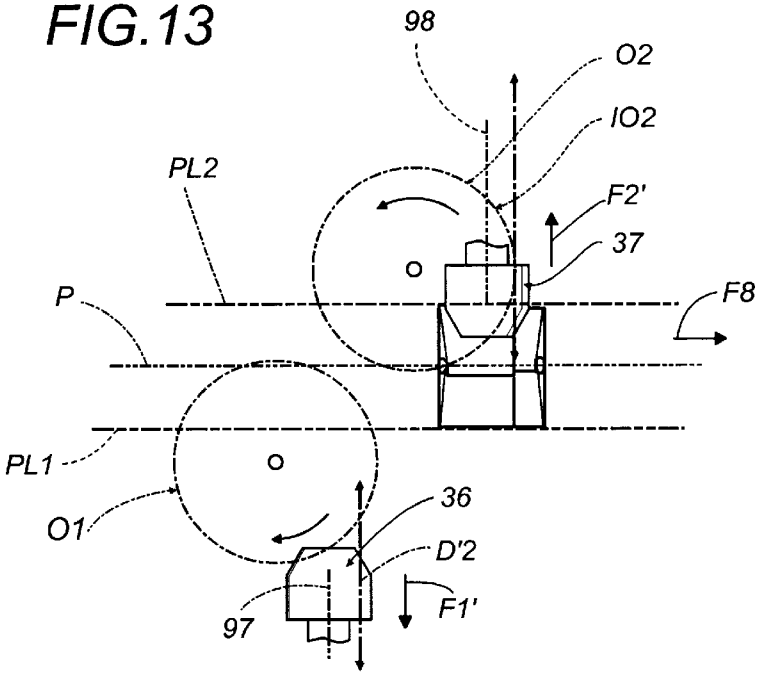
Figure 13A:
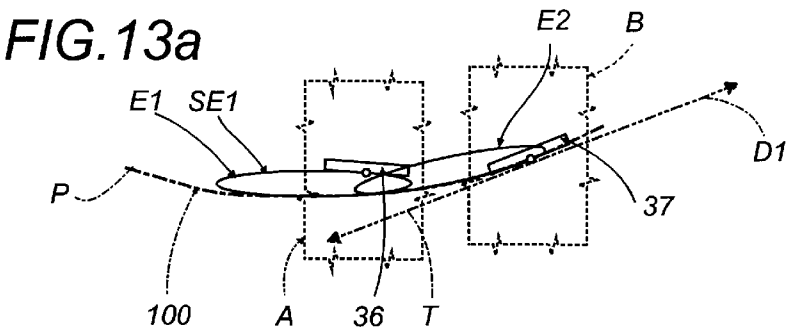

A gradual and increasingly notable increase in the speed of rotation of the first and second driven gears 61, 62 corresponds with a gradual increase in the speed of rotation of the first and second driven shafts 47, 48, which also corresponds with a gradual and increasingly notable increase in the speed of the tool 36, from the point of maximum penetration in the wrapper 2*a* (FIG. 8) until the moment in which the tool 36 moves away from the set 3—2*a* (FIG. 11). This is designed to cyclically correct the speed of translation of the tool 36 as it follows the operating portion IO1 of the first path O1, in such a way that the corresponding speed of the tool 36, calculated in the first direction D1, is always substantially equal to the speed of the sets 3—2*a*.

In contrast, following the second axial movement F10 of the first drive shaft 40, the first and second drive gears 59, 60 move in the direction and orientation indicated by the arrow F10, which is the same as the orientation F5 of the peripheral speed of each driven gear 61, 62 at their point of contact with the respective drive gears 59, 60. Thus, a momentary and gradual increase in the speed of rotation of the driven gears 61, 62 is generated. In other words, the sum of the speed of the axial movement F10 of the first drive shaft 40 and the peripheral speed of each driven gear 61, 62 is obtained at the point of contact.

An increase in the speed of rotation of the first and second driven gears 61, 62 corresponds with an increase in the speed of rotation of the respective first and second driven shafts 47, 48, which also corresponds with an increase in the speed of the tool 36, at the moment in which it is following the non-operating portion SO1 of its first closed path O1.

Similarly, with reference to the second mechanism 39 and the second tool 37, and starting with the same dynamic conditions imposed for the first tool 36, the cam 103 profile is shaped in such a way that it is synchronized with the forward movement of the second folding tool 37 along the second closed path O2, so as to cyclically impart to the second drive shaft 41 a first given axial movement towards the joint 46, in the direction and orientation indicated by the arrow F11 in FIG. 4, and a second axial movement away from the joint 46, in the direction and orientation indicated by the arrow F12.

The cyclical correction of the speed of translation of the second tool 37 while it follows the relative operating portion IO2 of the second closed path O2, is identical to that described relative to the first tool 36, and so is not described here. in practice, with reference to FIG. 1, each set consisting of a chocolate 3 and an intermediate wrapper 2*a*, gripped and supported by a respective pair of jaws 18, is fed along the path P with the opposite, parallel flaps 28 and 26 fed along the respective paths PL1 and PL2, on opposite sides of the path P, and reaches the folding device 32 at the folding station 31, which extends over the entire intermediate folding portion or arc 100 of the path P.

With reference to FIGS. 2, 3, 4, 5–14 and 5*a*–14*a*, each set 3—2*a* reaches the start of the first section 99 of the folding arc 100 in time with the first tool 36, whilst the second tool 37, as well as being offset by the distance "d" separating the axes 42 and 43 of the first and second drive shafts 40, 41, is also out of phase with the set 3—2*a* and, more precisely, is delayed relative to the first tool 36.

Figure 5:
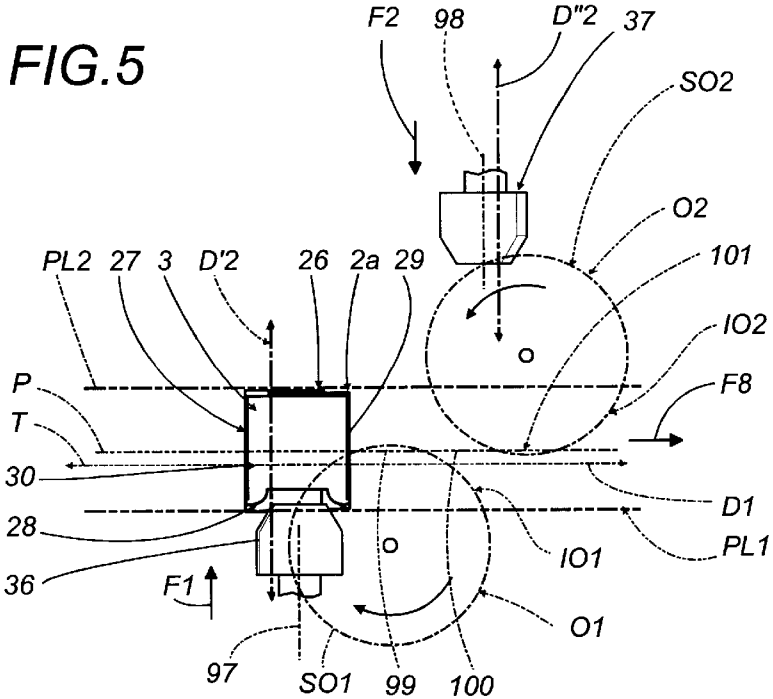
Figure 5A:
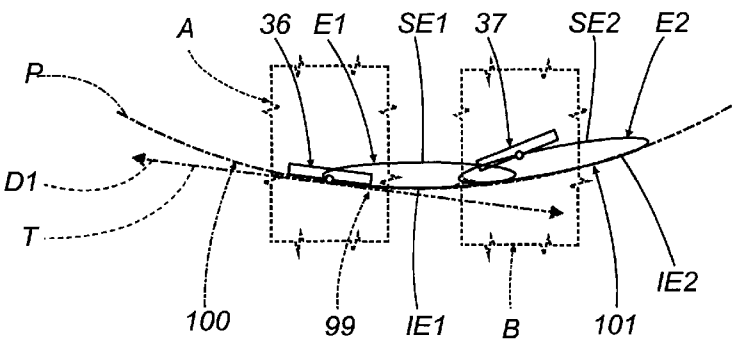

Following the rotation of the first and second driven shafts 47, 48 about the respective axes 51, 52, the first tool 36 begins to follow the operating portion IO1 of the first closed path O1, simultaneously moving towards the flap 28 in the second direction D'2 indicated by the arrow F1, and moving in the first direction D1, along which the instantaneous tangent T to the path P extends (FIG. 5).

At the same time, the movement of the first four-bar linkage 85 causes the first rod 79 to translate, keeping its longitudinal axis 97 and the respective tool 36 parallel with the direction D'2, whilst, due to the angle "beta" between the axis 83 of the first cylindrical guide pin 76 and the axis 51 of the first driven shaft 47, the first fork 77 causes the first rod 79 to oscillate in a clockwise direction about its longitudinal axis 97, so that, with reference to FIG. 3, the first folding tool 36 is substantially parallel with the lower surface 30 of the chocolate 3 and, therefore, with the instantaneous tangent T traced at the same given point on the folding arc 100. In this situation, the tangent T extends in the first direction D1, which is inclined in a clockwise direction relative to the horizontal plane.

With reference to FIGS. 2, 6, 7, 8, 9, 10 and 11, during the translation of the rod 79, which causes the first tool 36 to perform a complete forward movement along the operating portion IO1 of the first closed path O1, the axis 83 of the first pin 76 describes the abovementioned truncated cone K (FIG. 2) and the first fork 77 causes the folding tool 36 to oscillate in a counterclockwise direction about the axis 97 of the rod 79.

As a result, the folding tool 36 is gradually positioned substantially parallel with the lower surface 30 of the chocolate 3 and, therefore, with the abovementioned instantaneous tangent T, in all of the positions assumed by the lower surface 30 of the chocolate 3 as it is fed tangentially along the folding arc 100 of the path P. Obviously, this type of gradual positioning of the folding tool 36 occurs according to the methods and within the limits described previously with reference to FIG. 3.

From the above description, and in accordance with the illustrations in FIGS. 5*a*–14*a*, it follows that the first tool 36 moves forward along the operating section IE1 of its elliptical path E1 on the abovementioned plane A and squarely folds the respective flap 28 against the lower surface 30 of the chocolate 3, folding two respective triangular end portions 108, 109 of the flaps 27 and, respectively 29 of the intermediate wrapper 2*a*.

Simultaneously with the flap 28 folding stage, the first cam 102 imparts to the first drive shaft 40 the aforementioned first given axial movement towards the join 46, in the direction and orientation indicated by the arrow F9, and corrects the speed of translation of the tool 36 while it follows the operating portion IO1 of the first path O1, as described above and in such a way that the corresponding speed of the tool 36, calculated in the first direction D1, is always substantially equal to the speed of the sets 3—2*a*.

Figure 9:
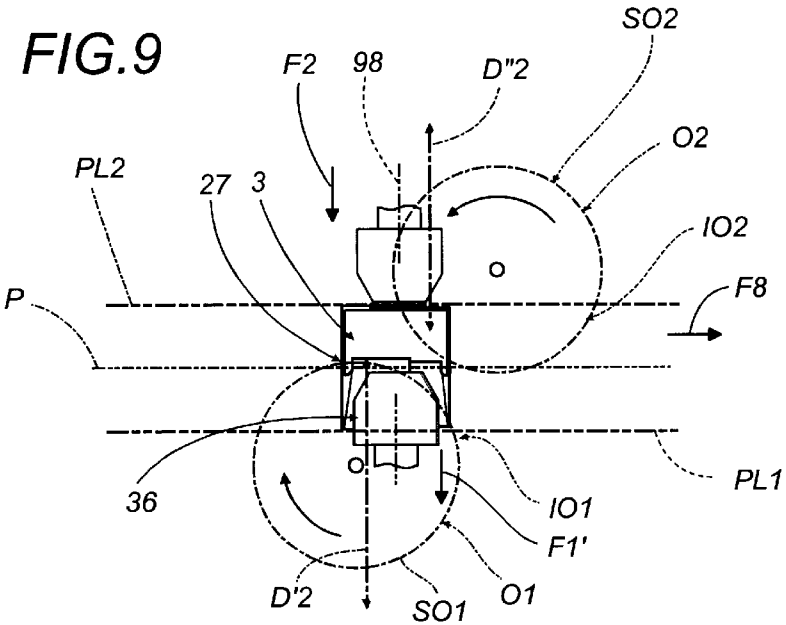
Figure 9A:
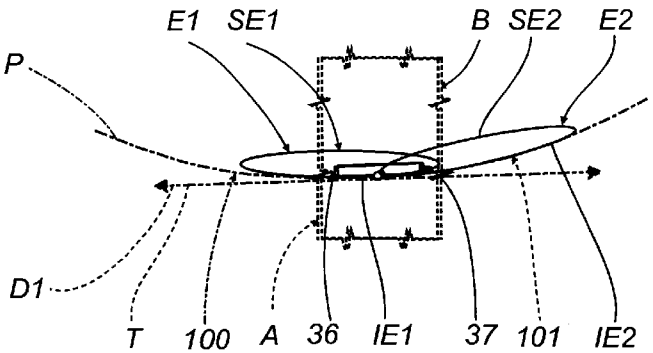
Figure 12:
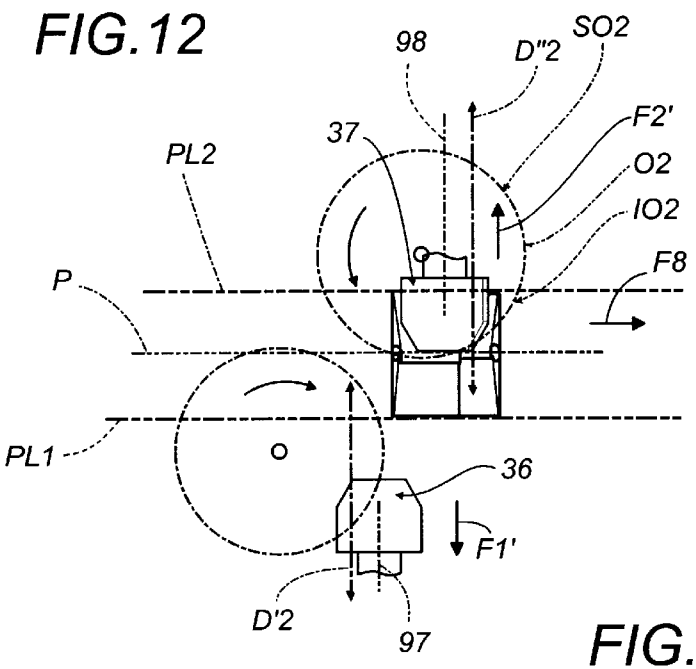
Figure 12A:
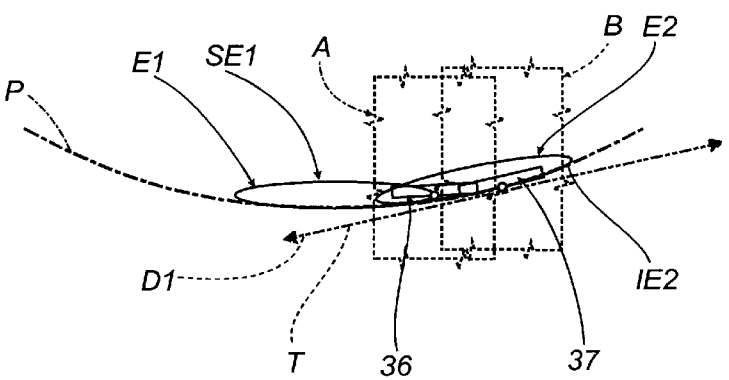

With reference to FIG. 9, at the moment in which the first tool, moving forward along its operating portion IO1, passes the point of maximum penetration in the wrapper 2*a*, the set 3—2*a* reaches the second folding tool 37 which, in the meantime, after the rotation of the third and fourth driven shafts 49, 50 about the respective axes 53, 54, begins to follow the operating portion IO2 of the second closed path 02, simultaneously moving towards the flap 26 in the second direction D"2 indicated by the arrow F2, and moving in the first direction D1, in which an instantaneous tangent T to the path P extends.

At this point, with reference to FIGS. 4, 9, 10, 11, 12, 13 and 14, the second folding tool 37 moves forward along its closed path O2 with a law of motion identical to that of the first tool 36 along its respective closed path O1, which is not, therefore, described.

The folding tool 37 moves along the operating section IE2 of its elliptical path E2 in the abovementioned plane B, squarely folding the flap 26 against the surface 30 of the chocolate 3 and determining the further folding of another two triangular end portions 110, 111 of the flaps 27 and, respectively, 29 of the intermediate wrapper 2*a* (FIG. 11), which finally assumes the configuration illustrated in FIG. 1*d*, in which the flaps 27 and 29 have a triangular configuration.

The movement cycle of the first and second folding tools 36 and 37 and, therefore, the folding cycle for the flaps 26 and 28, is repeated for each set consisting of a chocolate 3 and wrapper 2*a* which arrives at the folding station 31.

What is claimed is:

1. A method for continuously wrapping products, comprising stages for the continuous feed along a given path, an instantaneous tangent of which extends in a first direction, varying from point to point on the path, of a succession of products to be wrapped, together with respective sheets of wrapping material, the latter being at least partially folded around the respective products to define an intermediate wrapper having at least one flap substantially parallel with the plane in which said path lies and projecting in such a way that it is offset from a surface of the product; folding of the flap by at least one folding tool, extending along a respective axis and cooperating with the flap during the continuous feed of the intermediate wrapper and relative product along an intermediate folding portion of the path; the folding tool moving forward in a continuous, cyclical fashion along a closed path and moving with a law of motion which derives from the combination of at least two distinct movements, one being a movement in a second direction parallel with its own longitudinal axis and transversal to the plane in which the flap lies; the other movement being in the first direction of the path, following the continuous feed of the intermediate wrapper and relative product along the intermediate folding portion, and allowing the flap to be brought into contact with the surface of the product.

2. The method according to claim 1, wherein the folding tool has a folding element and wherein the law of motion with which the folding tool moves includes a further oscillating movement of the tool about its axis in such a way that the folding element, during its forward movement along the folding portion of the path, remains at all times in a position substantially parallel with the surface and with the instantaneous tangent, the latter varying from point to point on the first path, in all positions assumed by the surface of the product during its tangential forward movement along the intermediate folding portion.

3. The method according to either of the foregoing claims 1, wherein each intermediate wrapper has at least two opposite flaps, being substantially parallel with one another and with the plane in which the path lies; each flap being folded by at least a first and second folding tool, the latter being positioned substantially opposite one another on opposite sides of the path and cooperating with each respective flap as the intermediate wrapper and product are continuously fed along the intermediate folding portion of the path.

4. The method according to claim 3, wherein the first and second folding tools extend along respective separate axes, each tool moving with a respective law of motion which is asynchronous in relation to the law of motion of the other tool, thus folding the two respective flaps one after the other.

5. The method according to claim 4, wherein each product has at least one substantially flat surface with which the flaps are brought into contact, the folding tools having a substantially flat folding element, its width, measured in the first direction, being substantially equal to the width of the surface of the product measured in the same first direction; the first and second tools moving forward in a continuous, cyclical fashion along respective closed paths and moving with a law of motion which derives from the combination of three distinct movements, one being a movement in a second direction parallel with its own longitudinal axis and transversal to the plane in which the flap lies; another movement being in the first direction of the path, following the continuous feed of the intermediate wrapper and relative product along the intermediate folding portion, and allowing the flap to be brought into contact with the surface of the product; and the other movement being an oscillation of each of the tools about its own axis in such a way that, during its forward movement along the folding portion of the path, each folding tool is, at all times, substantially parallel with the surface and with the instantaneous tangent, the latter varying from point to point on the first path, in all of the positions assumed by the surface of the product during its tangential forward movement along the intermediate folding portion.

6. The method according to claim 5, comprising stages for making the first and second shafts cyclically perform an alternating movement along the respective axes, towards and away from the joint, during the rotation of the respective first and second drive shafts, and for each complete movement of the first and second folding tools along the respective first and second closed paths, thus, during the respective flap folding stages, cyclically correcting the speed of translation of the first and second folding tools as they follow relative operating portions of the first and, respectively, the second closed paths, in such a way that the corresponding speed of the first and second tools, being calculated in the first direction, is always substantially equal to the speed of the products and intermediate wrappers.

7. A device for continuously wrapping products, located along a portion of a wrapping machine equipped with a frame and a wall, and comprising a wrapping device having means for feeding, in a continuous fashion and -along a given path, an instantaneous tangent of which extends in a first direction which may vary from point to point on the path, a succession of products to be wrapped, together with respective sheets of wrapping material, the latter being at least partially folded around the products to define an intermediate wrapper having at least one flap substantially parallel with the plane in which the path lies and projecting in such a way that it is offset from a surface of the product; a folding device, designed to fold the flap and comprising at least one folding tool which extends along a respective axis and cooperates with the flap during continuous feed of the intermediate wrapper and relative product along an intermediate folding portion of the path; said folding tool moving in a continuous, cyclical fashion along a closed path and moving with a law of motion which derives from the combination of at least two distinct movements, one being a movement in a second direction parallel with its own longitudinal axis and transversal to the plane in which the flap lies; the other movement being in the first direction of the path, following the continuous feed of the intermediate wrapper and relative product along the intermediate folding portion, and allowing the flap to be brought into contact with the surface of the product.

8. The device according to claim 7, wherein the first folding tool of the folding device has a folding element whose width, measured in the first direction, is substantially equal to the width of the surface of the product measured in the same first direction; and wherein the law of motion with which the folding tool moves comprises a further oscillation of the tool about its own axis in such a way that, during its forward movement along the folding portion of the path, the folding tool is, at all times, substantially parallel with the surface and with the instantaneous tangent, the latter varying from point to point on the first path, in all of the positions assumed by the surface of the product during its tangential forward movement along the intermediate folding portion.

9. The device according to either of the foregoing claims 7, wherein each intermediate wrapper has at least two opposite flaps, being substantially parallel with one another and with the plane in which the path lies; and wherein the folding device comprises a first and a second folding tool, being positioned substantially opposite one another on opposite sides of the path and cooperating with each respective flap, folding them as the intermediate wrapper and product are continuously fed along the intermediate folding portion of the path.

10. The device according to claim 9, comprising a first and a second folding head, being positioned opposite one another, on opposite sides of the path and each having a respective first and second folding tool; the first and second folding heads being connected to a respective first and second mechanism, each receiving motion from a respective first and second drive shaft, the latter extending perpendicular to the wall and being irregularly aligned, with respective axes offset by a distance and parallel with one another.

11. The device according to claim 10, wherein the two drive shafts are rotated about their respective axes by a main drive shaft, the latter being connected to the first drive shaft by a pair of gearwheels, the two shafts being connected to one another at their breakpoint by a joint which allows motion to be transmitted from the first drive shaft to the second drive shaft at a synchronous speed.

12. The device according to claim 11, wherein the first and second mechanisms further comprise, respectively, a first and a second driven shaft and a third and a fourth driven shaft, each having an axis askew relative to the axis of the corresponding drive shaft to which they are kinematically connected in pairs at a first end, by respective first, second, third and fourth helical gear pairs, the latter being designed to allow the transfer of motion from the first and second drive shafts to the first and second driven shafts, which rotate about the respective axes, and, respectively, to the third and fourth driven shafts, which rotate about respective axes; said first, second, third and fourth driven shafts having, rigidly connected to the ends opposite their first ends, respective first, second, third and fourth transversal arms, their respective longitudinal axes being substantially perpendicular to the axes of the driven shafts, the first and, respectively, second folding heads being kinematically connected to the free ends of the arms.

13. The device according to claim 12, wherein the first folding head is kinematically connected to the free end of the first arm by a first turning pair with a first connecting fork connected to one end of a first rod, whilst the free end of the second arm is kinematically connected to the first head by a second turning pair, the latter having a first ball joint, keyed directly to the first rod close to the other end of the latter, facing the second folding head, the end of the rod being equipped with the first folding tool; the first turning pair having an axis inclined at a given angle relative to the axis of the first driven shaft, and the second turning pair having an axis parallel with the axis of the second driven shaft, and wherein the second folding head is kinematically connected to the free end of the fourth arm by a fourth turning pair, being equipped with a second connecting fork connected to one end of a second rod, whilst, at the free end of the third arm, the second head is kinematically connected, by a third turning pair with a second ball joint, the latter being keyed directly to the second rod close to the other end of the latter facing the first folding head, the rod having the second folding tool at said other end; the axis of the fourth turning pair being inclined at a given angle relative to the axis of the fourth driven shaft, and the axis of the third turning pair being parallel with the axis of the third driven shaft.

14. The device according to claim 13, wherein the first and second closed paths, along which the first and second folding tools move cyclically and continuously, lie in respective planes, each being inclined at an angle relative to the longitudinal axis of the corresponding first and second rods, complementing the angle of inclination of the axes of the respective driven shafts relative to the axes of the corresponding drive shafts.

15. The device according to claim 14, wherein, during the stage in which the corresponding flap is folded, the first folding tool moves along a first elliptical path, projecting from the first closed path in a plane that is substantially coplanar with the plane in which the flap lies; said first elliptical path consisting of two sections, one being a non-operating section, corresponding to a non-operating portion of the first closed path, not interfering with the flap or the path, the other being an operating section, corresponding to an operating portion of the first closed path, interfering with the flap and the path in such a way that it makes contact with and squarely folds the flap against the surface of the product; said operating section coinciding with a first section of the intermediate folding portion of the path; and wherein, during the stage in which the flap is folded, the second folding tool moves along a second elliptical path, projecting from the second closed path in a plane that is substantially coplanar with the plane in which the flap lies; said second elliptical path consisting of two sections, one being a non-operating section, corresponding to a non-operating portion of the second closed path and not interfering with the flap or the path, the other being an operating portion, corresponding to an operating portion of the second closed path, interfering with the flap and the path in such a way that it makes contact with and squarely folds the flap against the surface of the product; said operating section coinciding with a second section, subsequent to the first section, of the intermediate folding portion of the path.

16. The device according to claim 13, wherein, during the forward movement of the first folding tool along the relative first closed path, the axis of the first turning pair describes a truncated cone, the first fork causing the first rod to cyclically perform a clockwise and counter-clockwise oscillation about its longitudinal axis, so that, during its forward movement along the operating portion of the first closed path, the first folding tool is, at all times, substantially parallel with the lower surface of the product and with the instantaneous tangent, in all of the positions assumed by the lower surface during its tangential forward movement along the folding portion of the path; and wherein, during the forward movement of the second folding tool along the relative second closed path, the axis of the fourth turning pair describes a truncated cone, the second fork causing the second rod to cyclically perform a clockwise and counter-clockwise oscillation about its longitudinal axis, so that, during its forward movement along the operating portion of the second closed path, the second folding tool is, at all times, substantially parallel with the lower surface of the product and with the instantaneous tangent, in all of the positions assumed by the lower surface during its tangential forward movement along the folding portion of the path.

17. The device according to claim 7, wherein the first and second drive shafts are respectively keyed to a first and second cam, cooperating with the respective first and second pairs of idle gears, the latter being supported by respective fixed shafts, the first and second cams having profiles shaped in such a way that, during the rotation of the respective first and second drive shafts, and for each complete movement of the first and second folding tools along their respective first and second closed paths, the cam profiles cyclically impart to the first and second drive shafts an alternating motion, along the axes, towards and away from the joint, thus, during the flap folding stages, cyclically correcting the speed of translation of the first and second folding tools as they follow the relative operating portions of the first and, respectively, the second closed paths, so that the speed of the first and second tools, being calculated in the first direction, is always substantially equal to the speed of the products and intermediate wrappers.

* * * * *

UNITED STATES PATENT AND TRADEMARK OFFICE

CERTIFICATE OF CORRECTION

PATENT NO. : 6,477,822 B1
DATED : November 12, 2002
INVENTOR(S) : Spatafora et al.

It is certified that error appears in the above-identified patent and that said Letters Patent is hereby corrected as shown below:

Title page,
Item [73], Assignee should be changed from "Azionaria Costruzioni Macchine Automatiche S.p.A., Bologna (IT)" to -- Azionaria Costruzioni Macchine Automatiche A.C.M.A. S.p.A., Bologna (IT) --

Signed and Sealed this

Thirteenth Day of May, 2003

JAMES E. ROGAN
*Director of the United States Patent and Trademark Office*